United States Patent [19]

Linzer et al.

[11] Patent Number: 4,811,783

[45] Date of Patent: Mar. 14, 1989

[54] HEAT EXCHANGER TUBE BUNDLE PROTECTION APPARATUS

[75] Inventors: Frederick D. Linzer, Monroeville, Pa.; Paul L. Hauck, Tampa, Fla.

[73] Assignee: Westinghouse Electric Corp., Pittsburgh, Pa.

[21] Appl. No.: 106,900

[22] Filed: Oct. 8, 1987

Related U.S. Application Data

[63] Continuation of Ser. No. 671,821, Nov. 15, 1984, abandoned.

[51] Int. Cl.[4] ..... F28F 19/00

[52] U.S. Cl. ..... 165/134.1; 165/160; 122/DIG. 13

[58] Field of Search ..... 165/134.1, 160, 119; 122/DIG. 13

[56] References Cited

U.S. PATENT DOCUMENTS

| | | | |
|---|---|---|---|
| 1,782,829 | 11/1930 | Nash et al. | 165/134.1 |
| 2,024,496 | 12/1935 | Young | 165/134.1 |
| 3,275,072 | 9/1966 | Suchomel | 165/134.1 |
| 3,861,460 | 1/1975 | Lenhardt | 165/134.1 |
| 3,958,630 | 5/1976 | Smith | 165/134.1 |
| 4,142,578 | 3/1979 | Smith | 165/134.1 |

FOREIGN PATENT DOCUMENTS

| | | | |
|---|---|---|---|
| 469213 | 11/1928 | Fed. Rep. of Germany | 165/134.1 |
| 853080 | 10/1952 | Fed. Rep. of Germany | 165/134.1 |
| 0133849 | 1/1979 | German Democratic Rep. | 165/134.1 |
| 0001654 | 1/1977 | Japan | 165/134.1 |
| 0115957 | 10/1978 | Japan | 165/134.1 |
| 0203390 | 11/1983 | Japan | 165/134.1 |
| 7509960 | 2/1976 | Netherlands | 165/134.1 |
| 2070224 | 9/1981 | United Kingdom | 165/134.1 |
| 2082750 | 3/1982 | United Kingdom | 165/134.1 |

*Primary Examiner*—Samuel Scott
*Assistant Examiner*—John K. Ford

[57] ABSTRACT

The heat exchanger tube bundle fluid entry area is a region where particular problems can occur because pieces of metallic debris can collect and focus their mass at this low elevation. The metallic debris collected at the bottom of the annular downcomer passage can be swept into the tube bundle, wherein they will impact upon the tube bundle and can cause repture or large amounts of wear to the heat transfer tubes. To prevent this adverse condition, a circumferential row of cylindrical members are positioned peripherally about the entry portion of the tube bundle. These members will have an outside diameter, pitch, and geometric array corresponding to that of the heat tranfer tubes, so as to minimize pressure drop, due to flow across them.

18 Claims, 4 Drawing Sheets

HEAT EXCHANGER TUBE BUNDLE PROTECTION APPARATUS

This is a continuation of application Ser. No. 06/671,821, filed Nov. 15, 1984 now abandoned.

BACKGROUND OF THE INVENTION

1. Field of the Invention

The present invention relates in general to improvements in the construction of heat exchangers of the tube bundle type. The improvement is for protecting the heat transfer tubes from damage by contact with solid debris inadvertently contained within the working fluid which flows through the tube bundle to effect heat transfer therebetween.

2. Description of the Prior Art

Heat exchangers of the tube bundle type have been employed in a wide variety of applications to effect heat transfer to or from the working fluid. One such application is the use of a heat exchanger commonly referred to as a steam generator for converting the working fluid, i.e., water, into steam for the generation of electrical power. Such steam generators are usually constructed as a bundle of tubes extending from a supporting tubesheet and contained within a cylindrical wrapper. The cylindrical wrapper defines an annular downcomer passage between itself and the concentric outer shell. A mixture of fresh feedwater plus return water from a liquid/vapor separator enters at the tube bundle base through an opening in the wrapper at the bottom of the downcomer passage at the tubesheet. This opening, being arranged at the lowest elevation, is a natural collection point for solid debris left behind during steam generator manufacture or created by later repairs, internal breakage and/or wear during normal operation. Water, at this opening for entry into the tube bundle, is in a highly turbulent state because of sharp changes in the downcomer passage flow geometry and the 90° change in direction it must follow. Any debris at the bottom of the downcomer passage will be picked up by the vigorous water flow and thrown against the exposed thin-walled heat transfer tubes within the tube bundle. The impact of the solid debris with the heat transfer tubes can often cause tube rupture. Because of this turbulence and the flow changes caused by electrical load variations, the solid debris will not remain at the same location within the tube bundle. Such debris usually moves about the lower portion of the tube bundle, rubbing and wearing against the tubes, and is often thrown against those heat transfer tubes. Typical debris found in steam generators at this location can vary in size from one-half inch hexagonal nuts to pieces of steel broken loose from weldments serving as wrapper to shell supports.

Accordingly, it can be appreciated that there is an unsolved need to provide a protection apparatus for preventing impact and wear damage to the thin-walled heat transfer tubes within a tube bundle of a heat exchanger which is subject to repeated contact with solid debris contained within the working fluid.

SUMMARY OF THE INVENTION

It is broadly an object of the present invention to provide an apparatus for protecting the heat transfer tubes of a heat exchanger tube bundle. The invention fulfills the specific requirements of protecting the heat transfer tubes from wear or rupture caused by repeated contact with solid debris within the working fluid. Specifically, it is within the contemplation of one aspect of the present invention to provide a heat exchanger tube bundle protection apparatus which prevents pieces of metallic debris from being swept into the tube bundle where they will impact upon and potentially cause wearing or rupturing of the heat transfer tubes. The impacting can occur during all operating conditions of the heat exchanger and its associated support equipment.

Another object of the present invention is to provide a heat exchanger tube bundle protection apparatus which causes a minimal pressure drop of the working fluid flowing therethrough.

Another object of the present invention is to provide a heat exchanger tube bundle protection apparatus which is of simple design and construction.

Another object of the present invention is to provide a heat exchanger tube bundle protection apparatus which provides additional operational reliability and maintains tube bundle accessibility.

In accordance with one embodiment of the present invention, there is provided an improved heat exchanger of the type in which a bundle of heat transfer tubes is contained within a housing, and in which an opening is provided within the housing to permit entry for the flow of a fluid over the tubes. The improvement of the present invention comprises providing protecting means arranged at the entry periphery of a portion of the bundle adjacent the opening for protecting the tubes from contact with solid debris within the fluid, while allowing the unhindered flow of fluid therethrough.

Further in accordance with the above embodiment of the present invention, the protecting means are constructed of either solid rods or hollow tubes whose walls are much thicker than those of the heat transfer tubes.

Still further in accordance with the above embodiment of the present invention, the protecting means are constructed of a plurality of cylindrical members having an outside diameter, pitch, and geometric array corresponding to the outside diameter and pitch of the heat transfer tubes.

BRIEF DESCRIPTION OF THE DRAWINGS

The above description, as well as further objects, features and advantages of the present invention will be more fully understood by reference to the following detailed description of the presently preferred, but nonetheless illustrative, heat exchanger tube bundle protection apparatus. These are drawn in accordance with the present invention, when taken in conjunction with the accompanying drawings, wherein.

DESCRIPTION OF THE PREFERRED EMBODIMENT

Figure 1:
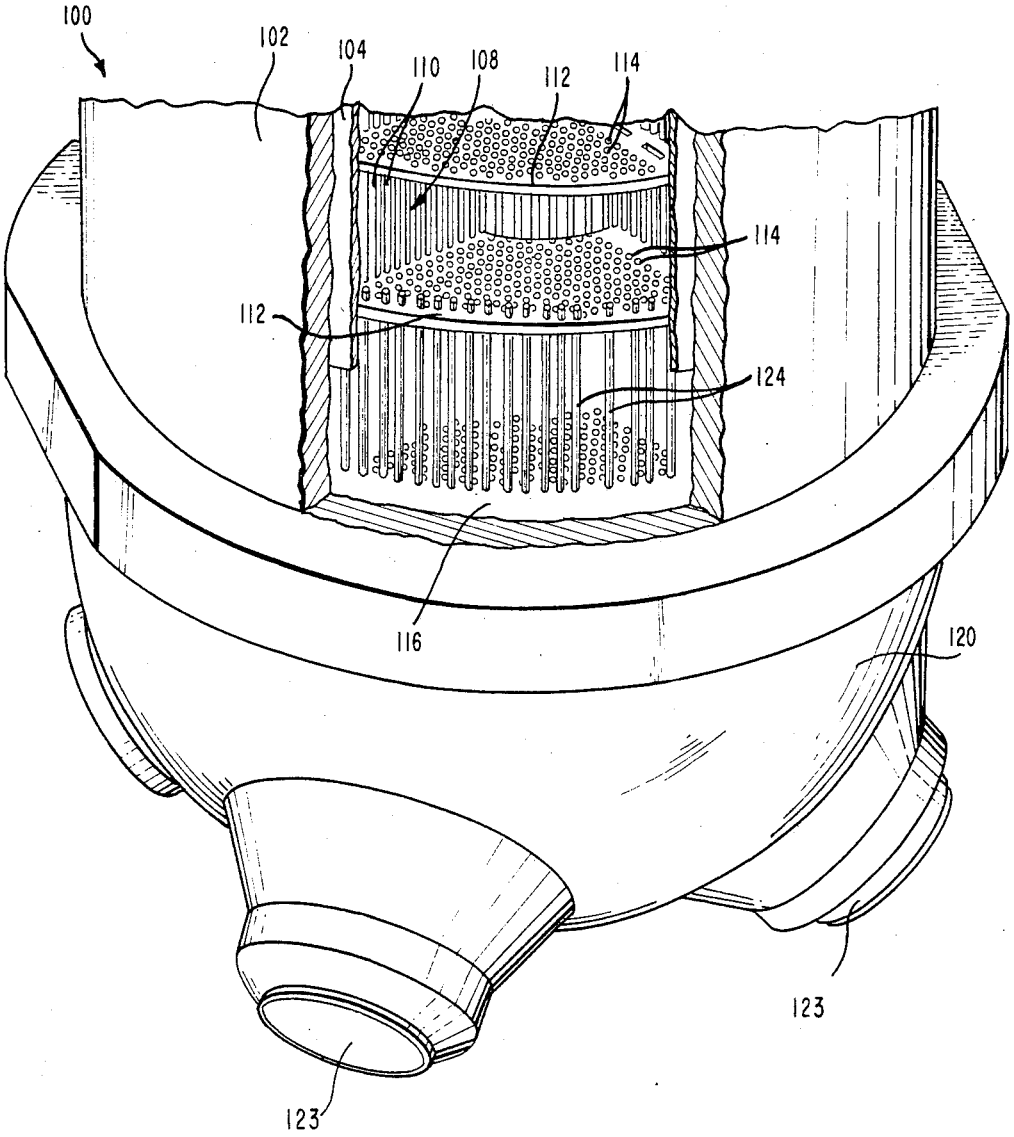
FIG. 1 is a perspective view of a heat exchanger having a portion thereof cut away, and showing the protection apparatus arranged about the periphery of a lower portion of the heat transfer tubes of the contained tube bundle.

Referring now to the drawings, wherein like reference numerals represent like elements, there is shown in FIG. 1 a portion of a heat exchanger, for example, a steam generator, and generally designated by reference numeral 100. The heat exchanger 100 is constructed of an outer cylindrical shell 102 and an inner concentric cylindrical wrapper 104, which define therebetween an annular downcomer passage 106, as more clearly shown in FIG. 2. Contained by the cylindrical wrapper 104 is a tube bundle 108, constructed generally of a plurality of heat transfer tubes 110, and maintained in fixed spaced relationship by a plurality of parallel spaced-apart flow distribution support baffles 112. The flow distribution support baffles 112 are provided with a plurality of openings 114 through which the heat transfer tubes 110 pass. The lower ends of the heat transfer tubes 110 extend through a tubesheet 116 and communicate with a cavity 118 defined by an end cap 120 having a plurality of entry holes 122 through which the heat transfer fluid which flows through the heat transfer tubes internal passage is supplied. End cap flow comes through nozzles 123 which penetrate the end cap wall. The lower end of the wrapper 104 terminates above the tubesheet 116 to provide an opening 125 communicating between the annular downcomer passage 106 and the lower portion of the tube bundle 108 confined by the wrapper.

Figure 2:
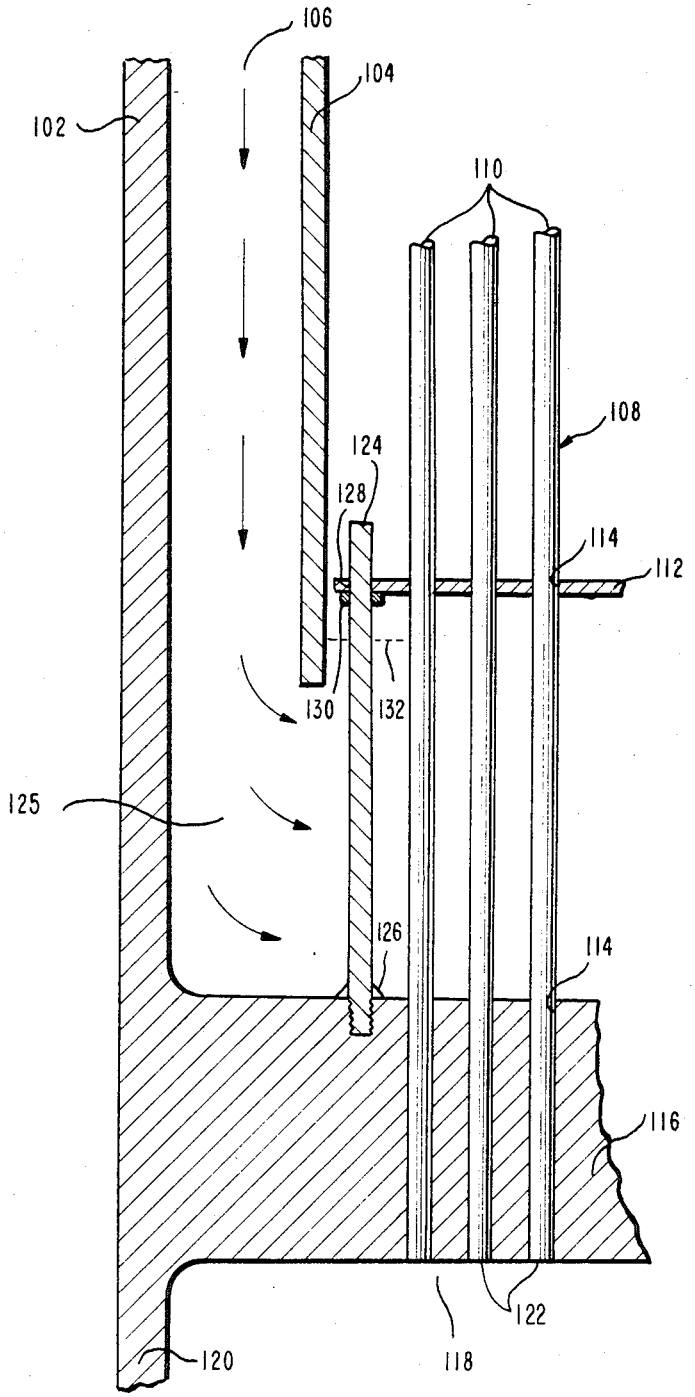
FIG. 2 is a cross-sectional view of a portion of the heat exchanger as shown in FIG. 1, showing the protection apparatus being secured to a tubesheet at the mouth of the annular downcomer passage.
Figure 3:
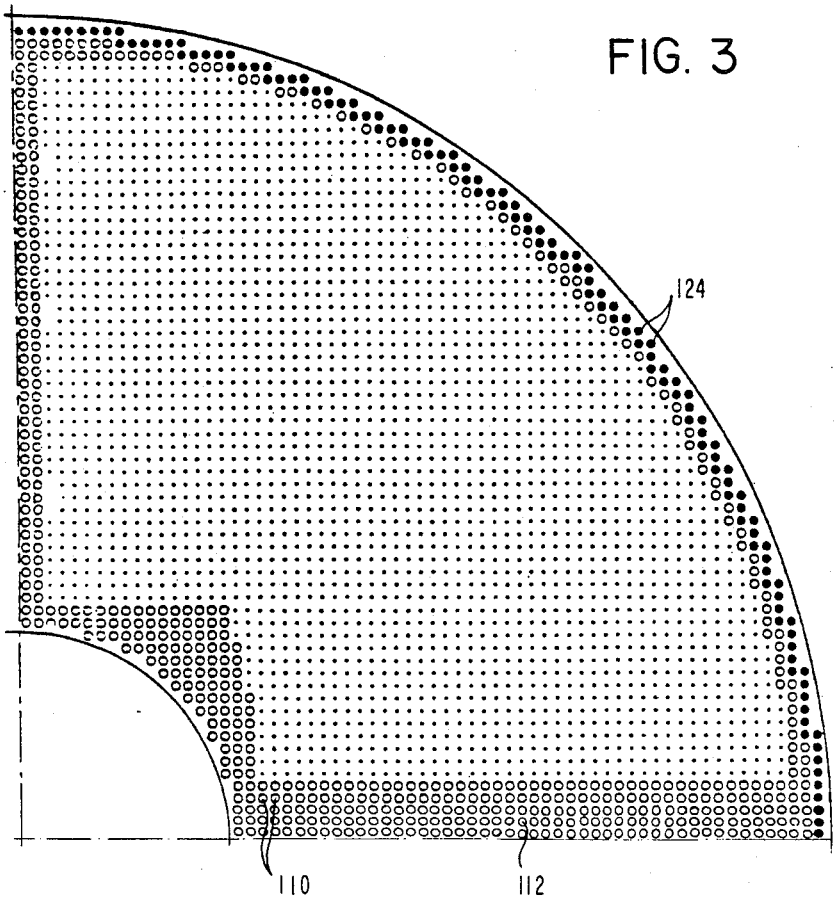
FIG. 3 is a top plan view of one-quarter of a typical tube bundle showing the arrangement of the protection apparatus about the periphery of the tube bundle.
Figure 5:
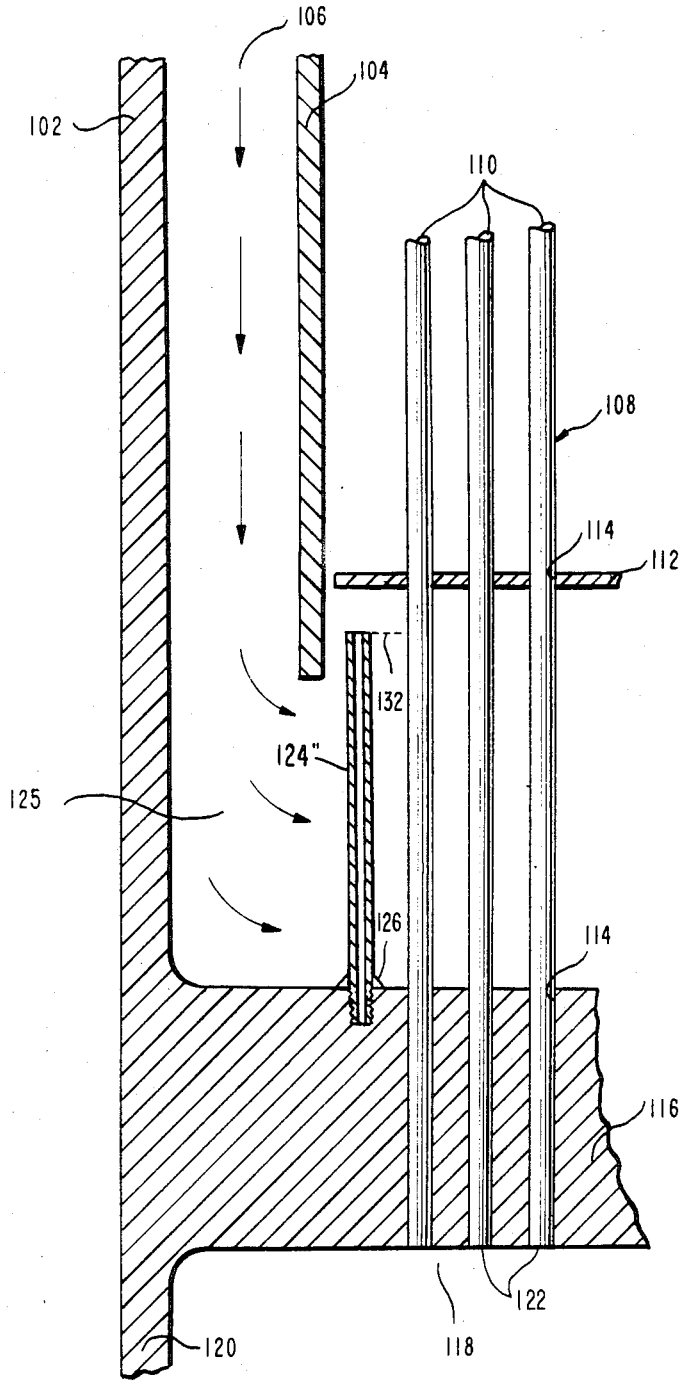
FIG. 5 is the cross-section view of a portion of the heat exchanger as shown in FIG. 1, showing the protection apparatus in accordance with another embodiment of the present invention.

Referring now to FIGS. 1–3, the protection apparatus of the present invention will be described. As previously noted, pieces of metallic debris can collect at the bottom of the annular downcomer passage 106 overlying the tubesheet 116 from where they can be swept into the tube bundle 108 by means of the flowing fluid, as indicated by the arrows. Because of the relatively high velocity and turbulence created within the opening 125, the debris, in the absence of the protection apparatus of the present invention, would impact and wear away or rupture the heat transfer tubes 110. In this regard, the protection apparatus of the present invention employs a plurality of strong cylindrical members 124 constructed as either solid rods or thick-walled, hollow tubes, (see element 124'' in FIG. 5) for example, having a wall thickness of greater than about 0.10 inches.

The cylindrical members 124 generally have a length sufficient to span the opening 125 and are arranged around the lower peripheral portion of the tube bundle 108 in alignment with the longitudinal axis thereof. The cylindrical members 124 are dimensioned to have an outside diameter corresponding to the outside diameter of the heat transfer tubes 110 and are arranged in an array having a pitch corresponding to the pitch of the heat transfer tubes. In this regard, the cylindrical members 124, by having the same outside diameter and pitch as that of the heat transfer tubes 110, act like another row of heat transfer tubes 110 to the flowing fluid such that the pressure loss of the fluid flowing through the annular downcomer passage 106 and across the cylindrical members into the tube bundle 108 is almost negligible, typically less than 0.04 pounds per square inch. Accordingly, the cylindrical members function as an almost indestructable screen against impacting pieces of metallic debris swept along by the fluid flowing within the annular downcomer passage 106. In one embodiment of the present invention, the cylindrical members 124 represent in number approximately 5% of the heat transfer tubes 110.

The cylindrical members 124 can be secured at their lower ends to the tubesheet 116 within openings 126 provided about the periphery of the tube bundle 108. The openings 126 may be threaded so as to receive a corresponding threaded portion of the lower ends of the cylindrical members 124, or may provide for a slip or friction fit therebetween. In any event, the cylindrical members 124 can be spot-welded or permanently fastened in some other way to the tubesheet 116 if desired. The upper ends of the cylindrical members 124, may extend through aligned openings 128 provided within the first flow distribution support baffle 112. The upper end of the cylindrical members 124 can be secured to the support baffle 112 by means of a collar 130 engaging a portion of the cylindrical members, as well as by welding them together. As shown in FIG. 2, the cylindrical members 124 extend between the tubesheet 116 and the support baffle 112. However, it is not required that the cylindrical members 124 extend to the first support baffle 112. In this regard, it is only required that the cylindrical members 124 extend generally across the extent of the opening 125, whereby the upper end of the cylindrical members may terminate freely under the first support baffle at a location indicated, for example, by the dotted lines 132, see FIG. 5. Protection above the support baffle 112 is not required, as this flow distribution support baffle prevents any debris from passing there-beyond.

There has thus far been described an improved heat exchanger 100 of the type in which a tube bundle 108, constructed of heat transfer tubes 110, is contained within a cylindrical wrapper 104, and in which an opening 125 is provided within the wrapper for the flow of a fluid over the tubes. The improvement comprises a plurality of cylindrical members 124 arranged about the peripheral portion of the bundle in alignment with the longitudinal axis of the bundle and adjacent the opening for protecting the tubes from contacting solid debris within the fluid, while allowing the flow of the fluid therethrough. The cylindrical protection members have an outside diameter corresponding to the outside diameter of the tubes and are arranged in an identical array with an identical pitch corresponding to the pitch of the tubes.

Figure 4:
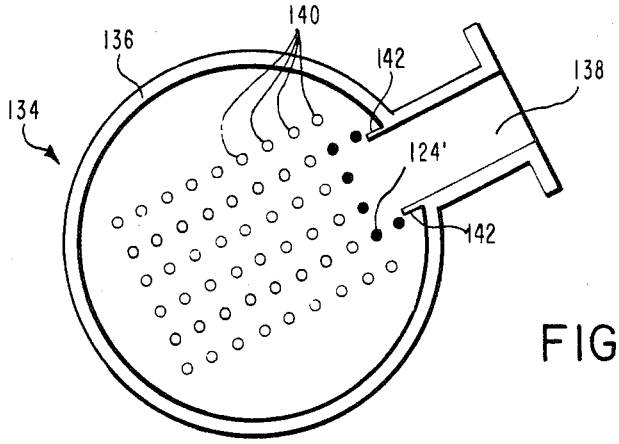
FIG. 4 is a cross-sectional view of a heat exchanger tube bundle showing the arrangement of the protection apparatus in accordance with another embodiment of the present invention.

Although the invention herein has been described with reference to particular embodiments, it is to be understood that these embodiments are merely illustrative of the principles and application of the present invention. For example, as shown in FIG. 4, a heat exchanger 134 is constructed of an outer housing 136 provided with an opening 138. A plurality of longitudinally extending heat transfer tubes 140 are arranged in an array within the heat exchanger 134. In accordance with the invention, cylindrical members 124' are arranged in the array of heat transfer tubes 140 at a peripheral portion adjacent the opening 138. The cylindrical members 124' are dimensioned to have an outside diameter corresponding to the outside diameter of the heat transfer tubes 140 and are arranged in an array having a pitch corresponding to the pitch of the array of heat transfer tubes. In addition, a pair of extensions 142 are arranged extending inwardly from the outer housing 136, so as to provide a barrier before the first cylindrical members 124' for solid foreign debris. Thus, the cylindrical members 124' prevent solid debris contained within the working fluid from contacting the heat transfer tubes 140, as previously described with reference to the embodiment illustrated in FIGS. 1–3.

It is, therefore, to be understood that numerous modifications may be made in the illustrative embodiments and that other arrangements may be devised without departing from the spirit and scope of the present invention as defined by the appended claims.

We claim as our invention:

1. An improved heat exchanger of the type in which a bundle of heat transfer tubes arranged in an array having a minimum pitch is contained within a housing, and in which an opening is provided within said housing for the flow of a fluid over said tubes, wherein the improvement comprises protecting means arranged at the periphery of a portion of said bundle adjacent said opening for protecting said tubes from contact with solid debris within said fluid, while allowing the low of said fluid therethrough, said protecting means arranged spaced from said tubes in an array having a pitch corresponding to said minimum pitch of said tubes, the array of said protecting means and the array of said tubes forming a combined array of protecting means and tubes having a uniform pitch throughout corresponding to said minimum pitch of said tubes.

2. The heat exchanger of claim 1, wherein said protecting means comprises a plurality of solid rods.

3. The heat exchanger of claim 1, wherein said protecting means comprises a plurality of hollow tubes.

4. The heat exchanger of claim 1, wherein said protecting means comprises a plurality of members having an outside size and shape corresponding to the outside size and shape of said heat transfer tubes.

5. The heat exchange of claim 1, wherein said protecting means comprises a plurality of cylindrical members having their longitudinal axes in alignment with the longitudinal axis of said bundle of said heat transfer tubes.

6. The heat exchanger of claim 1, wherein said protecting means extends along only a portion of the length of said heat transfer tubes and is coextensive with said opening.

7. The heat exchanger of claim 1, wherein said protecting means is secured at one end thereof to said heat exchanger.

8. The heat exchanger of claim 1, wherein said protecting means is secured at both ends thereof to said heat exchanger.

9. The heat exchanger of claim 7, wherein another end of said protecting means is unsecured.

10. The heat exchanger of claim 9, wherein the unsecured end of said protecting means is arranged beyond the extent of said opening.

11. The heat exchanger of claim 1, further including a pair of extension members attached to said housing and extending inwardly on opposite sides of said opening and having a portion arranged adjacent said protecting means for preventing the passage of said solid debris therebetween.

12. An improved heat exchanger of the type in which a bundle of heat transfer tubes arranged in an array having a minimum pitch is contained within a housing, and in which an opening is provided within said housing for the flow of a fluid over said tubes, wherein the improvement comprises a plurality of cylindrical members arranged at the periphery of a portion of said bundle in alignment with the longitudinal axis of said bundle and adjacent said opening for protecting said tubes from contact with solid debris within said fluid, while allowing the flow of said fluid therethrough, said cylindrical members having an outside diameter corresponding to the outside diameter of said tubes and arranged spaced from said tubes in an array having a pitch corresponding to said minimum pitch of said tubes, the array of said cylindrical members and the array of said tubes forming a combined array of cylindrical members and tubes having a uniform pitch throughout corresponding to said minimum pitch of said tubes.

13. The heat exchanger of claim 9, wherein said cylindrical members comprise a plurality of solid rods.

14. The heat exchanger of claim 9, wherein said cylindrical members comprise a plurality of hollow tubes.

15. The heat exchanger of claim 9, wherein said cylindrical members are arranged completely circumscribing said periphery of said bundle.

16. The heat exchanger of claim 12, wherein said cylindrical members are secured at one end thereof to said heat exchanger and unsecured at another end thereof.

17. The heat exchanger of claim 16, wherein the unsecured end of said cylindrical members is arranged beyond the extent of said opening.

18. The heat exchanger of claim 12, further including a pair of extension members attached to said housing and extending inwardly an opposite sides of said opening and having a portion arranged adjacent said cylindrical members for preventing the passage of said solid debris therebetween.

* * * * *